United States Patent [19]

White et al.

[11] Patent Number: 4,630,852

[45] Date of Patent: Dec. 23, 1986

[54] LATCHING MECHANISM

[75] Inventors: Robert M. White, Wilkes-Barre; Rodney E. Brancher, Wyoming, both of Pa.

[73] Assignee: InterMetro Industries Corporation, Wilkes-Barre, Pa.

[21] Appl. No.: 729,217

[22] Filed: May 1, 1985

[51] Int. Cl.[4] ..... E05C 19/06

[52] U.S. Cl. ..... 292/87; 292/DIG. 37; 292/DIG. 53

[58] Field of Search ..... 292/80, 86, 87, 246, 292/DIG. 37, DIG. 53, 19

[56] References Cited

U.S. PATENT DOCUMENTS

| | | | |
|---|---|---|---|
| 1,630,533 | 5/1927 | Lundberg | 292/341.18 |
| 2,050,078 | 8/1936 | Zell | 292/86 |
| 2,203,202 | 6/1940 | Kun | 292/87 |
| 2,656,206 | 10/1953 | Piker | 292/86 |
| 2,810,600 | 10/1957 | Kendrick | 292/357 |

*Primary Examiner*—Richard E. Moore

*Attorney, Agent, or Firm*—Fitzpatrick, Cella, Harper & Scinto

[57] ABSTRACT

A latching mechanism, for latching and unlatching a panel movable relative to a stationary panel of a container, includes a latch secured to one of the panels, and a structure defining an opening in the other of the panels through which the latch extends when the movable panel is in container-closing position. A latch keeper is positioned by a positioning device in operative position relative to the other of the panels to engage and retain the latch when the movable panel is in container-closing position. A keeper actuating device is operable to shift the latch keeper to latch-releasing position. The positioning device and the keeper cooperate to maintain the keeper in operative position and the keeper is manually shiftable from the operative position for disengagement from the other of the panels.

8 Claims, 6 Drawing Figures

LATCHING MECHANISM

BACKGROUND OF THE INVENTION

This invention relates to latching mechanisms and more particularly to such mechanisms which include a latch, a latch keeper and a latch release actuator and wherein the latch keeper and the latch release actuator are readily removable and remountable relative to a support structure therefor.

It is essential in a number of industries that transported substances be maintained under hygienic conditions, and therefore, that the container for such substances lend themselves to easy yet thorough cleaning. For example, in the food service industry, in which ready-to-serve foods are transported to hospitals, aircraft and the like, it is common practice to pack the food in containers which include a pivotable lid or closure that can be latched in the closed position.

Such containers must be thoroughly cleaned before each use in order to maintain the necessary hygienic conditions. However, in may such containers, it is difficult to remove particles of the transported substances from parts of the latching mechanism such as the latch keeper when the keeper is disposed inside the container.

SUMMARY OF THE INVENTION

In its preferred embodiment, the present invention is a latching mechanism of the class described which overcomes the foregoing difficulties and disadvantages.

For attaining the objectives mentioned above, and to be expressed later, the principal characteristic feature of a device in accordance with the present invention resides in the fact that the latch keeper is mounted within the container so as to engage a latch fixed to a pivotable lid or panel of the container and retain the lid in container-closing position. Yet the latch keeper is readily removable, preferably without the use of tools, for effective cleansing of the container interior and of the keeper. Additionally, upon removal of the keeper, the latch release actuator is also readily removable, for the same purpose. It will be understood that the keeper and actuator may be mounted on the pivotable door or panel of the container and the latch mounted within the container.

The keeper may be constituted by a body, means frictionally securing the body to a panel of the container in a manner such that the keeper may be shifted relative to the panel to a position from which it is dismountable from the panel. The keeper is preferably formed of flexible material and has a body portion bowed centrally away from the panel while a keeper actuating member in the form of a headed button is disposed in a hole formed in the panel so that the button head bears against the central region of the keeper and can move or flex the keeper to latch-releasing position upon the application of manual pressure at the distal end of the button shank. In this way, the button is retained in the panel by its head, which cannot fit through the hole in the panel, and the keeper itself against which the head bears. The keeper is, of course, provided with means such as a slot for engaging and retaining a latch when the keeper is in normal, operative position.

More specifically, the latching mechanism in accordance with the present invention for latching and unlatching a panel movable relative to a stationary panel of a container as by pivoting about a hinge thereon includes, latch means secured to one of the panels, means defining an opening in the other panel through which the latch means extends when the movable panel is in containerclosing position, a latch keeper and means positioning the keeper in operative position relative to the other panel to engage and retain the latch means when the movable panel is in container-closing position. Keeper actuating means are operable to shift the latch keeper to latchreleasing position. According to the novel arrangement of the invention, the positioning means and the bowed, flexible nature of the keeper cooperate to inhibit the keeper from moving from its operative position thus to maintain it in that position. However, the keeper is manually shiftable from that operable position for disengagement from the panel to which it is mounted thus to permit easy cleaning of the keeper and the area of the panel to which it is normally mounted.

The keeper may include an elongate portion and the positioning means is preferably constituted by a keyhole slot formed at each end of the elongate portion as well as a pair of headed studs fixed to the panel to which the keeper is normally mounted, each stud being adapted to enter one of the slots to position the keeper in its operative position.

It is preferred that the elongate portion be bowed between its ends away from the panel to which it is normally mounted so that it bears frictionally at its ends between the stud heads and the adjacent panel. Accordingly, the keeper is inhibited against movement to a position from which it may be dismounted or disengaged from its associated panel as when the enlarged portions of the keyhole slots register with the stud heads.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

A preferred embodiment of the invention has been chosen for purposes of illustration and description, and is shown in the accompanying drawing.

DETAIL DESCRIPTION OF THE PREFERRED EMBODIMENT

Figure 1:
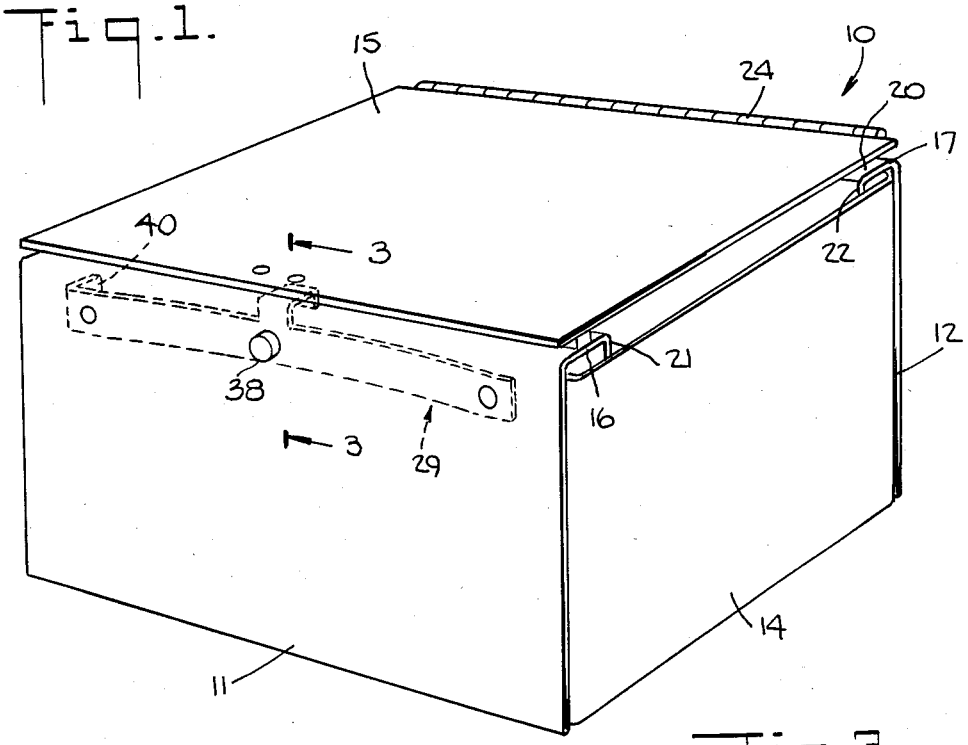
FIG. 1 is a perspective view of a container utilizing a latching mechanism according to the present invention.
Figure 3:
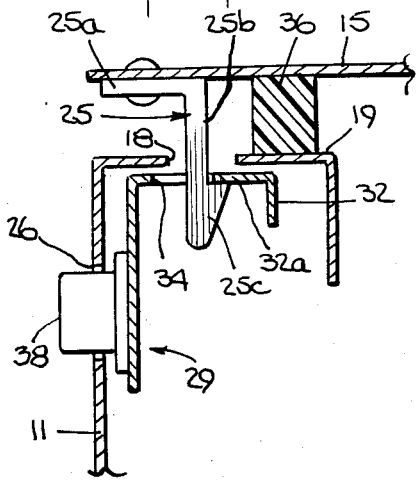
FIG. 3 is a cross-sectional view taken along plane 3—3 of FIG. 1 illustrating the mechanism in latching position.
Figure 2:
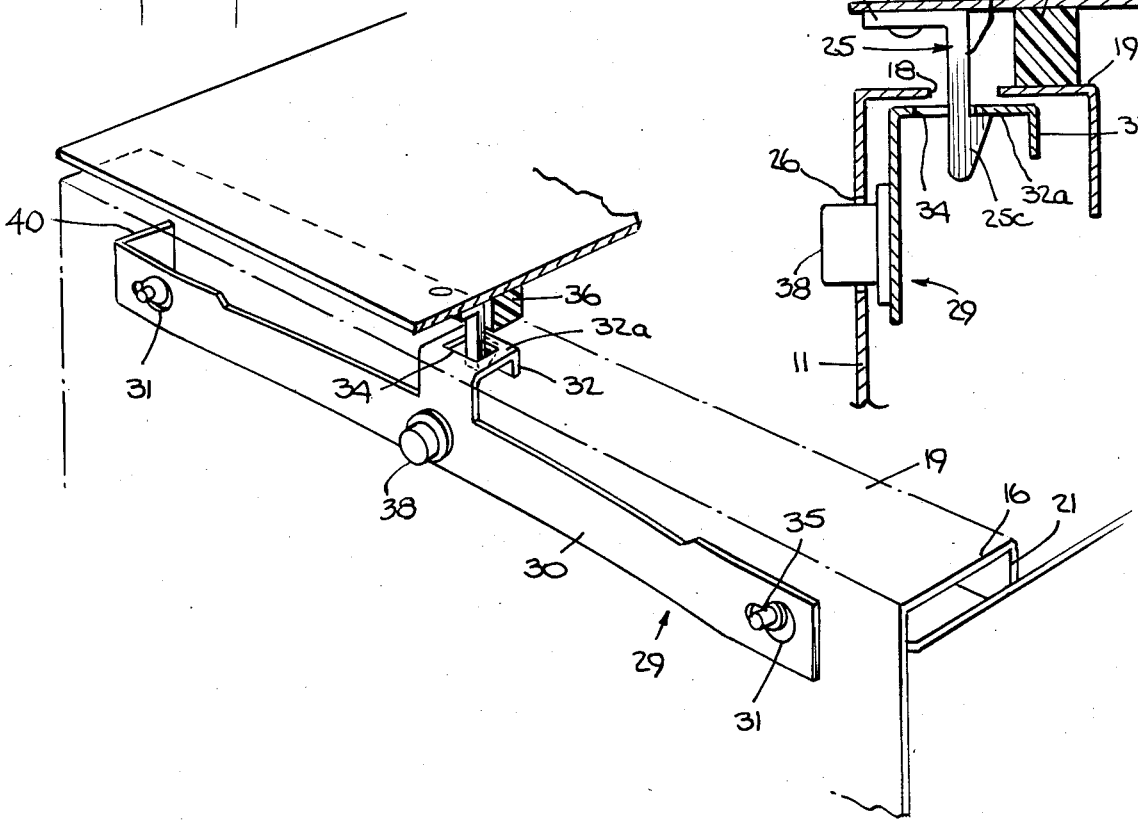
FIG. 2 is an enlarged perspective view of a portion of the container of FIG. 1 partially broken away and partially in phantom better to illustrate the latching mechanism.

Referring now to the drawing, and more particularly to FIGS. 1 to 3, there is shown a container generally indicated at 10 of stainless steel or the like, of a type useful in the transportation of ready-to-serve food. It is to be understood that the particular structure of the container 10 shown in the figures and described below is chosen only for purposes of explaining an illustrative embodiment of the latch mechanism of the invention. Of course the specific structure of the container will be dictated by the purpose to which it is to be put. The latch mechanism of the invention may be adapted equally advantageously to many different container constructions and the present invention is not limited to any particular one.

The illustrative container 10 comprises front and rear walls 11 and 12, side walls 14 (only one side wall being shown), a bottom wall (not shown) and a movable panel or lid 15. The front and rear walls 11 and 12 overextend the upper edges of the side walls 14 and are each provided at their upper edges with an inwardly extending flange 16 and 17 respectively each defining respective flat horizontal surfaces 19 and 20 and merging at their inner edges with a depending flange 21 and 22. The flange 16 has an opening 18 formed therein, for example, midway between the sidewalls 14 of the container.

The lid 15 is hinged as at 24 to pivot between opened and closed positions along an axis parallel to and slightly above the surface 20. A latch 25 is provided at the central region of the marginal edge of the lid opposite the hinged edge, as shown in FIG. 3. The latch is constituted by a flat base **25*a* adapted to be secured by bolts, rivets or the like to the inner surface of the lid and an arm 25*b* depending from the base and terminating in an offset latching hook 25*c***.

The front wall 11 of the container is punched to define an opening 26 near its upper edge and aligned with the latch 25 and the second opening 18 formed in the flange 16 is similarly aligned with the latch 25, both for a purpose later to be described.

A keeper generally indicated 29 is provided within the container 10 for securing the latch 25, and thus the lid 15, in closed position. In the illustrated embodiment, the keeper preferably includes an elongate body 30 of thin flexible material formed with a keyhole slot 31 at each end, the major axis of each such slot corresponding to the longitudinal axis of the body 30. The keeper is formed at its center with an upstanding section 32 which may take the form of an inverted J, the base **32*a* of which is provided with a square or rectangular opening 34**.

The container wall 11 has a pair of headed studs 35 extending inwardly thereof and spaced to register with the slots 31 of the keeper so that the large portions of each slot may receive a head of one of the studs 35. Therefore, the keeper may be shifted so that the shank of each slot receives the stem of its corresponding stud thus to position the opening 34 in the base **32*a* of upstanding section 32 in registry with the opening 18 in surface 19**.

The keeper 29 is so constructed that, when positioned by the studs 35 as described, it bows centrally outwardly away from the wall 11, such that at some region at or near the ends of body 30, it bears frictionally against the inner surface of that wall with sufficient force to inhibit the keeper from shifting to a position at which the large portions of the slots 31 register with the heads of studs 35.

As described thus far, it will be seen that when the lid 15 of the container 10 is moved to closed position, the latching hook **25*c* passes through opening 18 in surface 19 and cams the central region of keeper 30 inwardly of the container as it bears against an edge of opening 34 of section 32 until the hook 25*c* passes through that opening 34 while compressing a plastic foam gasket 36 between the lid 15 and the surface 19. At this point, due to its inherent resilience, the keeper returns to its starting position to overlie the hook whereupon the lid 15** is latched closed.

Figure 5:
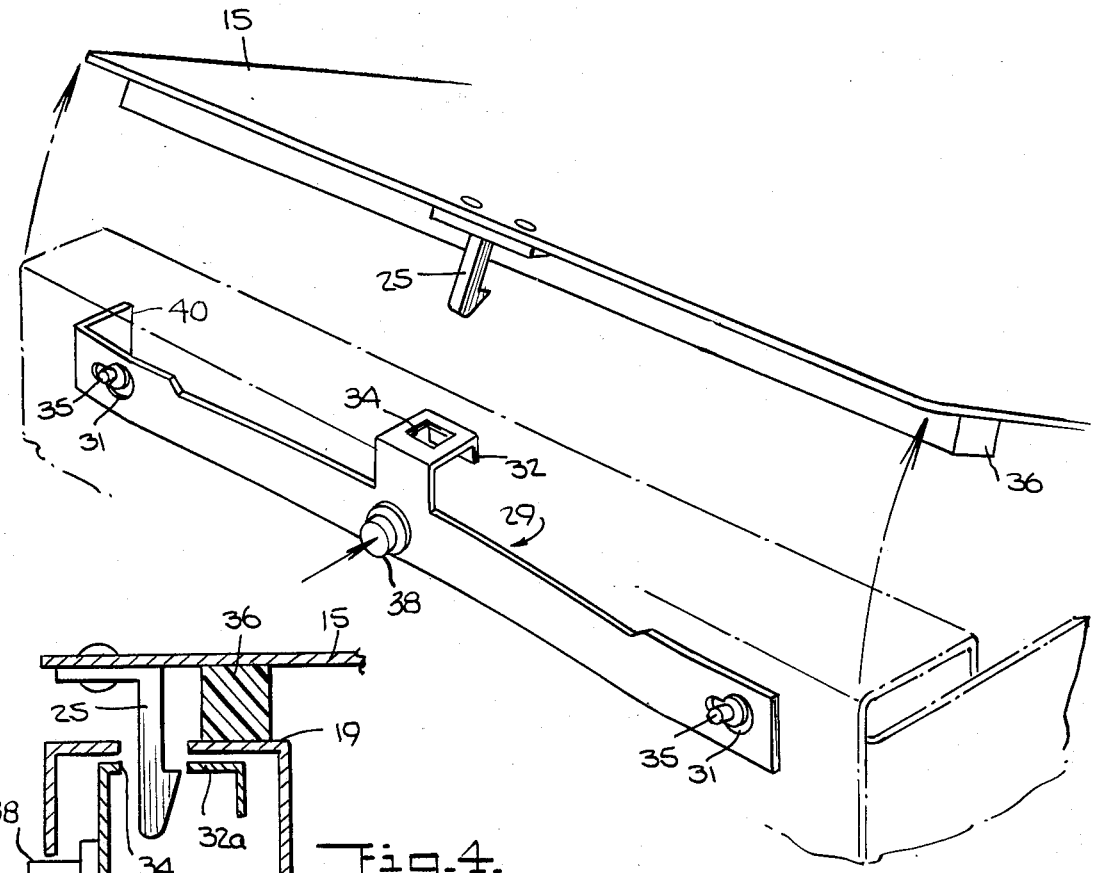
FIG. 5 is a fragmentary, perspective view illustrating the movable panel or lid of the container partially opened.
Figure 4:
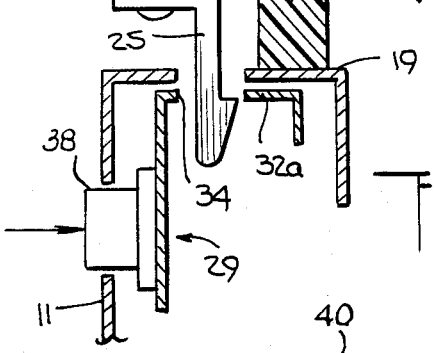
FIG. 4 is a view similar to FIG. 3, but illustrating the mechanism in unlatched position.

In order to release or unlatch the lid, a keeper actuator is provided in the form of a headed plastic button 38 the shank of which extends through the opening 26 in the front wall 11 of the container and the head of which bears against the central region of the body 30 of keeper 29. As shown in FIGS. 4 and 5, upon manual depression of the button shank in the direction of the arrow, the central region of the keeper body 30 moves inwardly until the latching hook 25C clears the inner edge of opening 34 (FIG. 4) at which time the resilience of the gasket 36 lifts the lid 15 in the direction as shown in FIG. 5.

Figure 6:
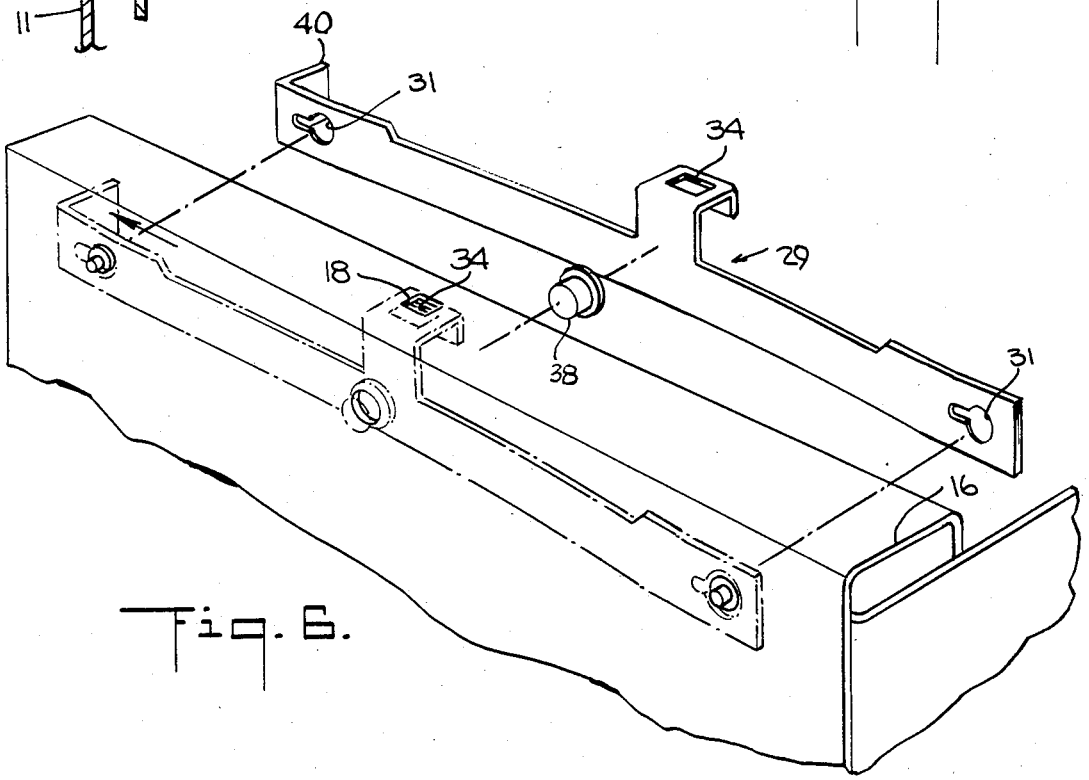
FIG. 6 is a perspective view illustrating the latch mechanism in disassembled condition and, in phantom, in assembled condition, relative to the container.

Referring now to FIG. 6, it will be seen that the keeper 29 and the button 38 may readily be removed from the container simply by sliding the keeper relative to the studs 35 until the large portions of the keyhole slots 31 register with the stud heads, as shown in phantom in the figure. Thereupon the keeper may be lifted out of the container, as indicated by the solid line depiction. If desired, a manually engageable tab 40 may be formed on the keeper body to assist in removal and installation of the keeper. With the keeper removed, the button 38 is removed merely by pushing it through the opening 26 into the container. Also the keyhole slot 31 at the extreme of the keeper opposite the tab 40 may be replaced by a linear slot, narrower than the head of the associated stud 35 and opening to the extreme end of the keeper.

From the foregoing description, it will be seen that the present invention produces a locking mechanism of the class described wherein the latch keeper and a latch release actuator are readily mountable to a support structure therefor such as a container and whereby the container and the latch mechanism parts may also be conveniently dismounted from the container and thoroughly and easily cleaned.

The structure and operation of the novel latching mechanism will now be understood and that the advantages thereof will be fully appreciated by those persons skilled in the art. However, it will be further understood that modifications may be made to this latching mechanism in order to adapt it to particular applications.

What is claimed is:

1. A latching mechanism for latching and unlatching a panel movable relative to a stationary panel of a container, said latching mechanism comprising:

latch means secured to one of said panels;

means defining an opening in the other of said panels through which opening said latch means extends when said movable panel is in container-closing position;

a latch keeper including an elongate portion formed with a slot at each end thereof;

means removably mounting said keeper in operative position with said other of said panels, said keeper being mounted by said mounting means for movement between a latching position engaging and retaining said latch means when said movable panel is in container-closing position and a latch-releasing position releasing said latch means to permit said movable panel to move away from said stationary panel, said mounting means including a pair of headed studs fixed to said other panel, each stud being formed to enter and to disengage from one of said slots removably to position said keeper in said operative position, said studs and said slots being formed to permit manual shifting of said keeper from said operative position for disengagement from said other of said panels by disengaging said studs from said slots; and keeper actuating means operable to move said latch keeper, mounted by said mounting means, to said latch-releasing position, said mounting means and keeper cooperating to maintain said keeper in said operative position.

2. A latching mechanism according to claim 1, wherein at least one of said slots is a keyhole slot.

3. A latching mechanism according to claim 1, wherein said elongate portion is formed of resilient material and said keeper actuating means is a headed button extending through an opening formed in said other panel, the head of said button bearing against said elongate portion and the shank of said button being manually depressible to cause said head to flex said elongate portion to move said keeper to said latch releasing position.

4. A latching mechanism according to claim 3, wherein said elongate portion is bowed between its ends away from said other panel whereby it is frictionally retained at its ends between said studs and said other panel.

5. A latching mechanism for latching and unlatching a panel movable relative to a stationary portion of a container to open and close the panel, said latching mechanism comprising:

latch means secured to one of said movable panel and said stationary portion;

means defining an opening in the other of said movable panel and said stationary portion through which said latch means extends when said movable panel is in container-closing position;

a latch keeper including a portion formed with a slot therein;

means removably mounting said keeper in operative position with said other of said movable panel and said stationary portion of the container, said keeper being mounted by said mounting means for movement between a latching position engaging and retaining said latch means when said movable panel is in container-closing position and a latch-releasing position releasing said latch means to permit said movable panel to move away from said stationary portion, said mounting means including means associated with said other of said movable panel and said stationary portion and extending through said slot normally frictionally to engage said portion of said keeper to retain said keeper in operative position, said frictional engaging means and said slot being formed to permit shifting of said keeper from said operative position to shift said slot relative to said frictional engaging means thereby to disengage said slot and frictional engaging means and permit disengagement of said keeper from said other of said movable panel and said stationary portion; and keeper actuating means mounted to extend through an opening in said other of said movable panel and said stationary portion and abut said keeper, said actuating means being manually depressible to shift said keeper to said latch-releasing position, said mounting means cooperating with said keeper to maintain said keeper in operative position.

6. In a latching mechanism for latching and unlatching a panel mounted for movement relative to a stationary panel and including latch means mounted with one of said panels capturable for latching and releasable for unlatching the other of said panels; a latch keeper comprising:

a body for capturing and releasing said latch means;

means associated with the other of said panels for frictionally securing said body to the other of said panels, said securing means including means defining at least one keyhole slot formed in one of said body and the other of said panels and stud means mounted on the other of said one of said body and the other of said panels, said stud means being formed to extend into said slot, said stud means and said slot further being formed to permit shifting of said body to shift said stud means relative to said slot to disengage one from the other and thereby permit said latch keeper to be demounted from said other of said panels.

7. A latching mechanism according to claim 6, wherein said body is formed of resilient material and is centrally bowed away from said other of said panels.

8. A latching mechanism according to claim 7, wherein said keeper is provided with means for engaging and retaining said latch means, said mechanism further comprising a keeper actuating member mounted with said other of said panels to apply a force to the centrally bowed portion of said body to move it to latch-releasing position upon the application of manual pressure to said actuating member.

* * * * *

UNITED STATES PATENT AND TRADEMARK OFFICE

CERTIFICATE OF CORRECTION

PATENT NO. : 4,630,852

DATED : December 23, 1986

INVENTOR(S) : LATCHING MECHANISM

It is certified that error appears in the above-identified patent and that said Letters Patent is hereby corrected as shown below:

COLUMN 1

Line 22, "may" should read --many--.

COLUMN 2

Line 3, "containerclosing" should read --container-closing--.

Line 8, "latchreleasing" should read --latch-releasing--.

COLUMN 4

Line 60, "mechanism for" should read --mechanism--.

COLUMN 5

Line 41, "mechanism for" should read --mechanism--.

Signed and Sealed this

Twenty-fifth Day of August, 1987

*Attest:*

*Attesting Officer*

DONALD J. QUIGG

*Commissioner of Patents and Trademarks*